US007220928B2

(12) United States Patent
Haake et al.

(10) Patent No.: US 7,220,928 B2
(45) Date of Patent: May 22, 2007

(54) SAFETY STRIP FOR A STRIKING EDGE SAFETY DEVICE OR CLOSING EDGE SAFETY DEVICE

(76) Inventors: Andre Haake, Drosselstiege 28, Stadtlohn (DE) 48703; Oliver Haake, Bunings Weide 37, Stadtlohn (DE) 48703; Patrick Haake, Wullener Strasse 92, Vreden (DE) 48691

( * ) Notice: Subject to any disclaimer, the term of this patent is extended or adjusted under 35 U.S.C. 154(b) by 199 days.

(21) Appl. No.: 10/520,877

(22) PCT Filed: Apr. 14, 2004

(86) PCT No.: PCT/DE2004/000765
§ 371 (c)(1),
(2), (4) Date: Jan. 10, 2005

(87) PCT Pub. No.: WO2004/095486

PCT Pub. Date: Nov. 4, 2004

(65) Prior Publication Data

US 2005/0259367 A1 Nov. 24, 2005

(30) Foreign Application Priority Data

Apr. 19, 2003 (DE) ..... 103 18 319
May 21, 2003 (DE) ..... 103 22 866

(51) Int. Cl.
*H01H 3/16* (2006.01)

(52) U.S. Cl. ..... 200/61.41; 200/61.43

(58) Field of Classification Search .. 200/61.41–61.44, 200/17 R, 52 R, 61.19, 61.58 R, 61.62, 61.7, 200/61.71, 61.73–61.78, 61.81, 61.82, 506, 200/85 R–85 A; 49/21, 26–28
See application file for complete search history.

(56) References Cited

U.S. PATENT DOCUMENTS

| | | | | |
|---|---|---|---|---|
| 3,654,411 | A * | 4/1972 | Wohnlich et al. | 200/61.19 |
| 4,385,219 | A * | 5/1983 | Finlayson | 200/506 |
| 4,446,342 | A * | 5/1984 | Roberts | 200/5 R |
| 4,636,603 | A * | 1/1987 | Pliml | 200/296 |
| 4,701,582 | A * | 10/1987 | Hayashi et al. | 200/61.42 |
| 5,929,406 | A * | 7/1999 | Thiel | 200/61.43 |
| 6,107,580 | A * | 8/2000 | Hoshikawa et al. | 200/61.43 |
| 6,198,056 | B1 * | 3/2001 | Wisinski | 200/17 R |
| 6,396,010 | B1 * | 5/2002 | Woodward et al. | 200/61.43 |
| 6,635,834 | B1 * | 10/2003 | Wenner | 200/61.08 |
| 6,753,486 | B2 * | 6/2004 | Matsui | 200/61.41 |

FOREIGN PATENT DOCUMENTS

EP 0 234 523 11/1989

* cited by examiner

*Primary Examiner*—Michael A. Friedhofer
(74) *Attorney, Agent, or Firm*—Merchant & Gould P.C.

(57) ABSTRACT

A safety strip for a striking edge protection device or closing edge protection device has contact elements arranged transversal to the longitudinal extension of the holding bodies, and the points of contact of the contact elements enable a flow of current from one side of one holding body to the other side of the other holding body. To this end, the holding bodies can be provided in the form of contact strips, spring brackets or the like, and sensors can be used instead of the contact elements. These sensors are mounted transversal to the longitudinal extension of the contact strips or of the spring bracket, and the sensors, via the operation thereof, actuate the electrical switching device.

17 Claims, 4 Drawing Sheets

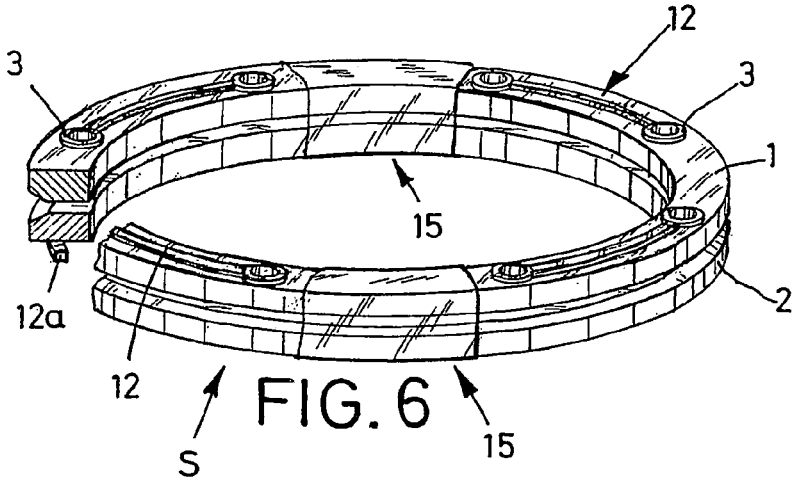
FIG. 6
FIG. 5
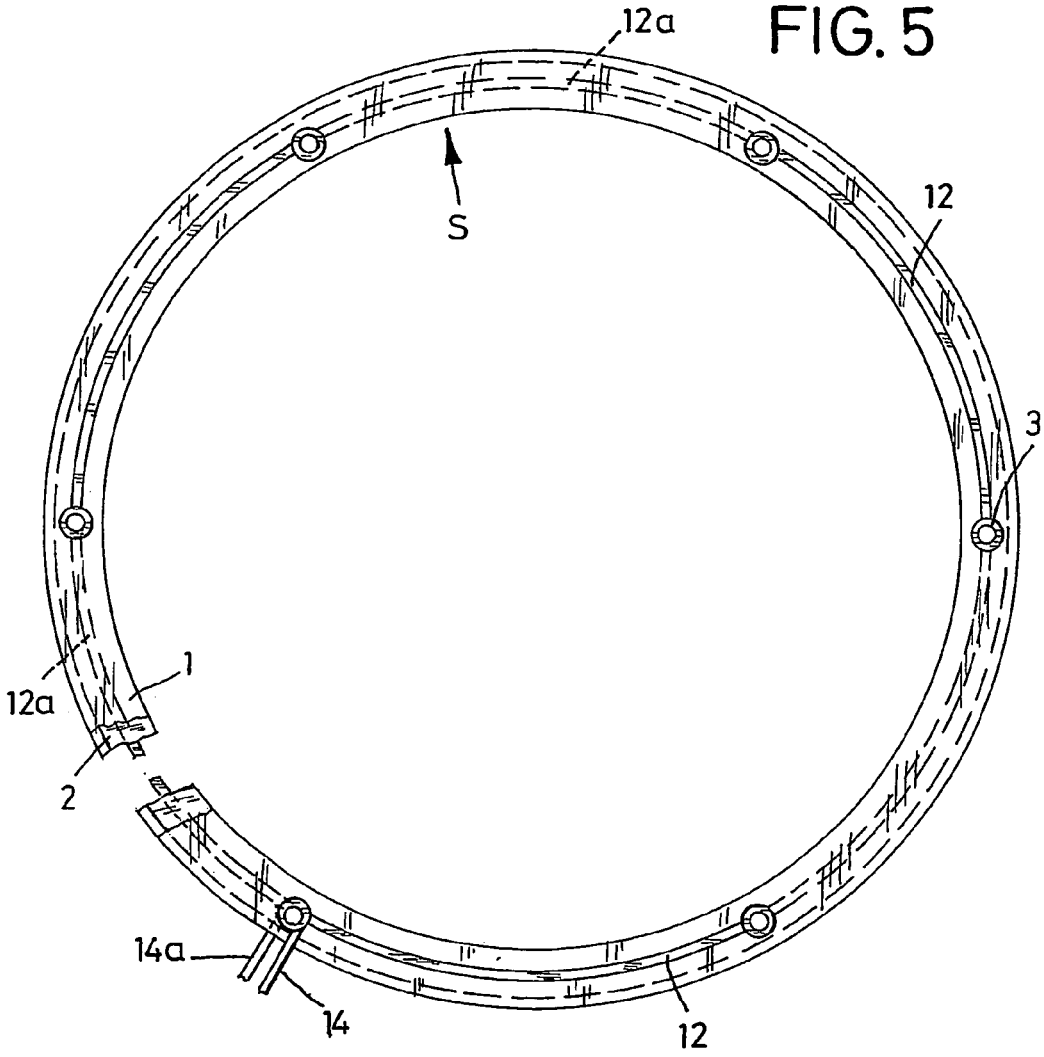

SAFETY STRIP FOR A STRIKING EDGE SAFETY DEVICE OR CLOSING EDGE SAFETY DEVICE

BACKGROUND OF THE INVENTION

1. Field of the Invention

The invention relates to a safety strip as a connecting block for a striking edge or closing edge protection device or switch pad with an electrical switching device.

2. Description of the Prior Art

In EP 0 234 523 B1, which forms the class for the independent claims, is described a striking edge protection device with a safety strip, wherein the holding bodies (here called contact rollers) consist in each case of cylindrical rollers, the contact rollers meeting each other in a productive manner at the front-end points of contact. These holding bodies display contact elements, which in the class-forming literature passage are described as sleeves consisting of copper or nickel silver. The holding bodies are acted on by an elastic prestress through the fact that arranged in the interior of the contact rollers is an elastic cord that forces the individual contact rollers, and thus the holding bodies, in an axial direction against each other. Arranged between the individual holding bodies are insulating rings, which are arranged between the individual holding bodies with projecting wedge surfaces oriented radially with respect to the insulating-ring axis. In the event of a force oriented preferably transversely with respect to the longitudinal extension of the contact chain, only a minimum of wedging effect between the contact elements and the insulating ring results in an interruption of the closed-circuit current, which leads to a switching function within the switching device. After unloading of the contact chain, an automatic neutral position for closing the closed-circuit current circuit occurs. For the sensitivity of the response, the degree position of the collaborating wedge surfaces is essential.

With this known apparatus it is scarcely possible to construct safety strips that must be installed in a small radius, for example around a central pipe, in order to serve as a striking protection device.

For this application case, the use of the spheres from FR 21 35 922 A5 as contact elements is also not applicable. In this arrangement, the spheres do not center themselves in the soft hose, but rather, in order to make way for the prestress generated through the hose, the spheres shift against each other, so that a straight-line sphere chain is not present in the installed state.

Characteristic of both of the arrangements belonging to the prior art is the fact that a separation of the points of contact occurs in the case of a striking load upon the safety strip in a direction transverse to the longitudinal axis of the safety strip; for example, in the case of EP 0 234 523 B1 the elastic cord is stretched and in the case of the device according to FR 21 35 922 A5 the elastic hose is elongated.

Described in EP 421048 B1 is a safety strip that is to be used as a switch pad, wherein a multitude of contact elements and wedge elements are provided that are pulled against each other by means of an elastic cord. The wedge elements are formed as wedge plates and the contact elements as contact plates, whereby in the switching-ready state the elastic cord lies at different heights in the contact plates and in the wedge plates.

SUMMARY OF THE INVENTION

The invention is based on the object of creating a safety strip that has high response sensitivity and can be installed in the smallest radiuses. A further goal is that the striking or closing edge protection device or switch pad be producible in a more cost-effective manner than the devices belonging to the prior art.

This object forming the basis of the invention is achieved through the teaching of the main claim.

Expressed in different words, according to the invention it is proposed that the contact elements be arranged transversely to the longitudinal extension of the safety strip and, via their contact points, allow a current flow that preferably flows from one side of one holding body to the other side of the other holding body.

The safety strip can, according to the invention, be designed as a spring bracket, where the legs of the bracket represent the holding bodies. On the other hand, it is possible to design the holding bodies as contact strips in which the contact elements, viewed over the length of the strip, are arranged at a distance from each other and are connected in series via conductive means. Possible, finally, are contact strips consisting of plastic and connected to each other via a hinge strip in a material-unified manner.

Viewed over the length of a safety strip, in the arrangement according to the invention fewer contact elements can be provided, since, by virtue of the formation of the safety strips of dimensionally stable material, the action of the insulating wedge elements also lifts or pushes apart the strips over a wider region than is the case with the devices according to the prior art, a current interruption nevertheless occurring immediately.

Through appropriate construction, the arrangement according to the invention can operate according to both the closer principle and the opener principle.

According to the invention, the contact strips can consist of a dimensionally stable material as well as of a rubber-elastic material.

Likewise, the insulating wedge elements can consist of dimensionally stable material and the insulating wedge elements can be designed as continuous insulating wedge strips.

The holding bodies, i.e. the contact strips or spring bracket, can be arranged together with the insulating wedge elements or insulating wedge strips in a receiving space that is enclosed by an outer housing wall. This outer housing wall can consist of elastic material as well as of rigid material. The receiving space itself can be bounded by elastic wall elements, so that, on the one hand, a sufficient degree of giving way is possible, and on the other hand the elastic prestress for the two holding bodies can be already achieved thereby.

It is likewise possible to apply the elastic prestress to the holding bodies by means of separate elastic tensioning elements.

The use of elastic elements to produce the receiving space also makes it possible for the contact strips or holding bodies, as the case may be, and the insulating wedge elements to be displaced transversely with respect to the contact strip, so that thereby the incorporation of a braking or slowing-down path is possible.

The safety strip, i.e. the holding bodies and the insulating wedge elements, can have a ringshaped form, can have a linear form, or display polygonal geometries. If the holding bodies and the insulating wedge elements have a semicircular form, the combination of individual piece elements in linear and circular manners is likewise possible.

The application field of the striking and closing edge protection device according to the invention is, among others, the securing of measuring arms on measuring machines and the securing of robot arms; applications as end-of-travel switches and as hinge switches are also possible.

Finally, according to the invention it is proposed that the holding bodies be formed as a contact strip or spring bracket and receive sensors, the sensors extending transversely to the longitudinal extension of the contact strip or the spring bracket. The sensor action affects an electrical switching apparatus.

Understood as a sensor in the context of the present invention is a component that detects physical or chemical magnitudes and converts these into electrical or digital signals, and is consequently suitable for measurement and switching. As sensors, photocells, optical fibers, ultrasound elements, magnetically active elements, or similar devices belonging to the prior art can be used.

BRIEF DESCRIPTION OF THE DRAWINGS

In the following, embodiment examples of the invention are explained with reference to the drawings. In the drawings:

FIG. 5: shows a plan view of the safety strip that is shown installed in FIG. 1;

FIG. 6: shows diagrammatic view of a further embodiment form of a ring-shaped safety strip;

DETAILED DESCRIPTION OF THE PREFERRED EMBODIMENT

Figure 1:
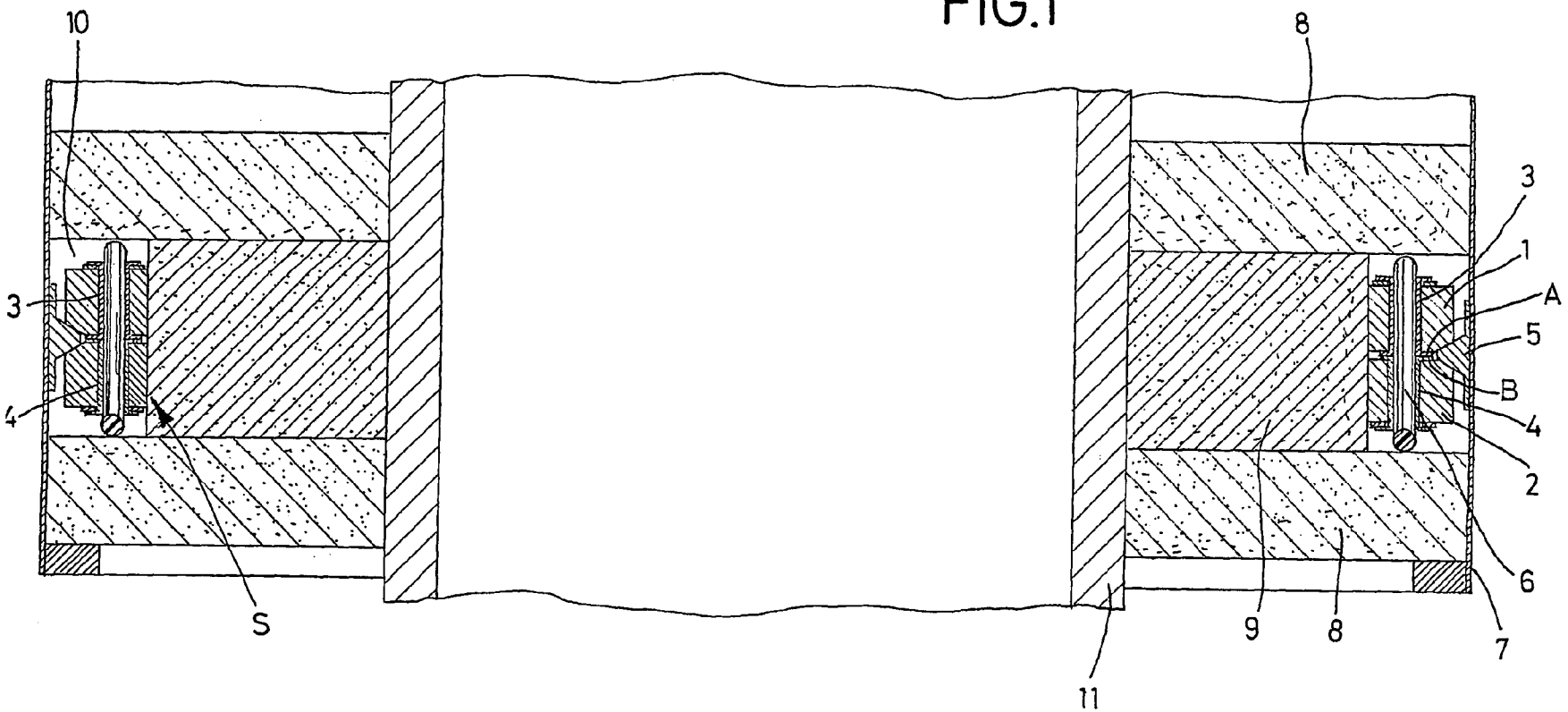
FIG. 1: shows a section through a safety strip as a contact ring.

Represented in section in FIG. 1 is a safety strip S as a contact ring that is placed around an inner pipe 11. This contact ring displays two holding bodies arranged one above the other and formed as contact strips 1, 2, which holding bodies in each case abut on each other with contact elements 3, 4, the contact elements 3 and 4 being formed of, for example, tubular rivets. The contact elements 3, 4 abut each other at contact points A and B. In the embodiment example represented in FIG. 1, placed into the contact elements 3 and 4 is a piece of elastic cord as a prestress element 6, which cord forces the two holding bodies, i.e. the contact strips 1 and 2, against each other, so that the two contact elements 3, 4 abut each other and thus close the contact points A and B.

The two contact strips 1 and 2 are open toward the outside in a wedge-shaped manner and inserted into this wedge space is an insulating wedge element 5, which is covered toward the outside by a housing wall 7. The contact strips 1 and 2 are situated in a receiving space 10, this receiving space 10, in the embodiment example according to FIG. 1, being formed through horizontally-oriented wall elements 8 and 8 consisting of polyurethane foam and enclosing between themselves a wall element 9 that likewise consists of polyurethane foam, but which can display a different solidity than the wall elements 8 and 8. In the represented embodiment example according to FIG. 1, the housing wall 7 closing off the receiving space 10 toward the outside consists of a relatively stiff material, so that in the event of a impact on an obstacle this housing is moved inwardly toward the receiving space 10, which is possible because the wall elements 8 and 8 can yield elastically. At the same time, however, the wall element 9 forms a certain resistance, so that the insulating wedge element 5 can penetrate into the corresponding space between the two contact strips 1 and 2 and cancel the contact between contact points A and B, thus causing a switching action.

Figure 2:
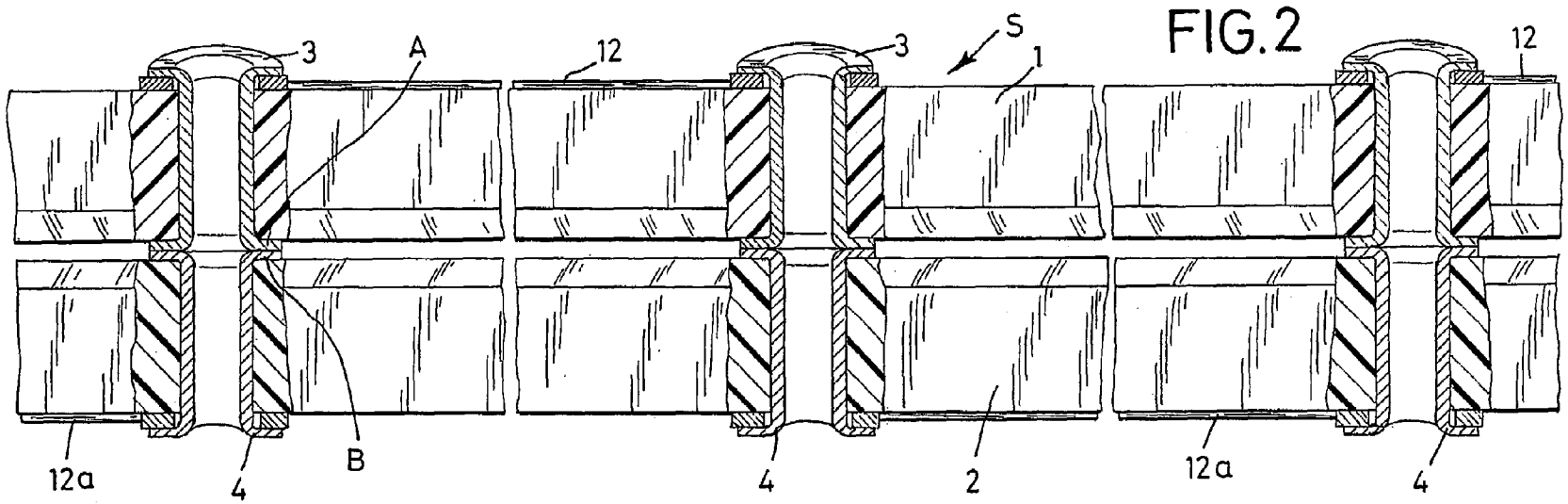
FIG. 2: shows a view of an elongated safety strip in section.
Figure 3:
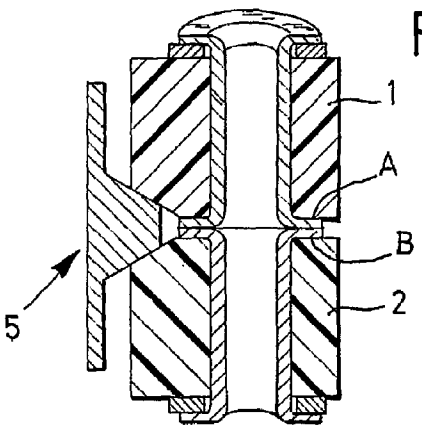
FIG. 3: shows a sectional representation at right angles to the representation corresponding to FIG. 2.

FIG. 2 shows, in a cut-away manner, an arrangement of an elongated safety strip S. Here, the holding bodies are formed as contact strips 1 and 2, the contact elements 3 and 4 are clearly recognizable, and in particular FIG. 3 shows the wedge-shaped insulating wedge strip 5, pressure upon which now moves the two contact strips 1 and 2 apart and thereby the contact points A and B are separated. The means whereby in the resting state the two contact strips 1 and 2 are forced against each other are not represented in FIGS. 2 and 3, but the electrical connections between the sequential contact elements are. Provided between the contact element 3 located at the center in FIG. 2 and the contact element 3 located on the left is an electrical conductor 12 that can be designed in a manner belonging to the prior art.

In the representation in FIG. 2, the conductor 12 lies on the top side of the contact strip 1. From the middle contact element 4 of the lower contact strip 2 an electrical conductor 12*a* leads to the lower contact element 4 located on the right in the drawing, and from this representation it is evident that the individual contact elements are connected in series, so that the current can flow from the left-located contact element 3 to the contact element 3 located in the middle, then via the contact elements 3 and 4 reaches the lower side of the strip 2, and there flows via the conductor 12*a* to the contact element 4 on the right side of the drawing, from where the current then flows again to the contact element arranged on the contact strip 1 and from here, via the electrical connection 12 shown in the drawing, to the next contact element.

Figure 4:
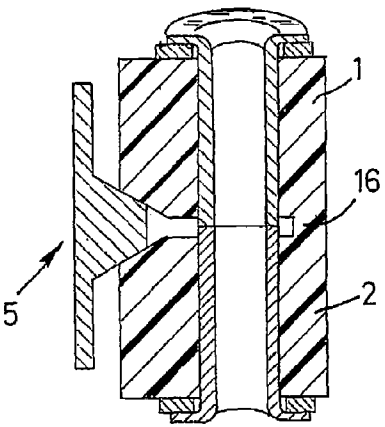
FIG. 4: shows a sectional representation through a modified design of the actual safety strip.

FIG. 4 shows an arrangement with two contact strips 1 and 2 and an insulating wedge element 5, wherein, however, the two contact elements 1 and 2 are firmly connected to each other, i.e. materially connected, through a hinge component 16. This hinge strip 16 can be designed as a film strip, so that the two contact strips 1 and 2 are easily swung open or closed. However, it is also possible, as represented in FIG. 4, to form this hinge strip 16 relatively large, so that thereby the required prestress of the two contact strips 1 and 2 is already achieved.

In any case, such a material-united design of the contact strips 1 and 2 offers a simplified production and operation possibility.

In the embodiment form according to FIG. 5, the electrical circuit is once again made clear. FIG. 5 shows that a circular safety strip 5 can display, for example, six contact elements 3 and 4. In FIG. 5, which shows a plan view of the upper contact strip 1, the upper contact elements 3 are visible. Represented by 14 is an electrical input line that leads to contact element 3 of the upper contact strip 1. From here, viewed toward the right in the represented embodiment example, an electrical conductor 12 leads to the contact element 3 of the upper contact strip 1, and from here the current can flow via the upper contact element 3 and the lower contact element 4 to the bottom of the lower contact strip 2. As shown in dashes at 12*a*, an electrical connection then takes place to the next contact element 4 of the lower contact strip 2, and from here the current can flow upward via the upper contact element 3 of the upper contact strip 1 and again reach an electrical conductor 12.

Represented at 14*a* is the return conductor of the current and it is evident that the individual contact elements 3 and 4 are connected in series.

Since the contact strips 1 and 2 consist of rigid material, an impact on the insulating wedge element 5 at any point suffices to cause a current interruption. However, let it be expressly pointed out that the arrangement according to the invention, which is represented in terms of the opener principle, can also operate according to the closer principle.

FIG. 6 shows a ring-shaped safety strip S with contact strips 1 and 2 and, for reasons of clarity, without the insulating wedge strip 5, wherein the upper contact element 3 is recognizable in the plan view. The elastic prestress between the two contact strips 1 and 2 is produced in this embodiment form through tube pieces 15, but it should be pointed out that the elastic prestress by which the contact strips 1 and 2 are pressed against each other can be designed in any manner.

Thus, for example, the two contact strips can also be placed into a rubber profile tube so that the profile is extruded, whereby, in contrast to the prior art, such a tube is no longer extended in length during the operation of the insulating wedge strip, but rather the diameter of the tube is enlarged.

Figure 7:
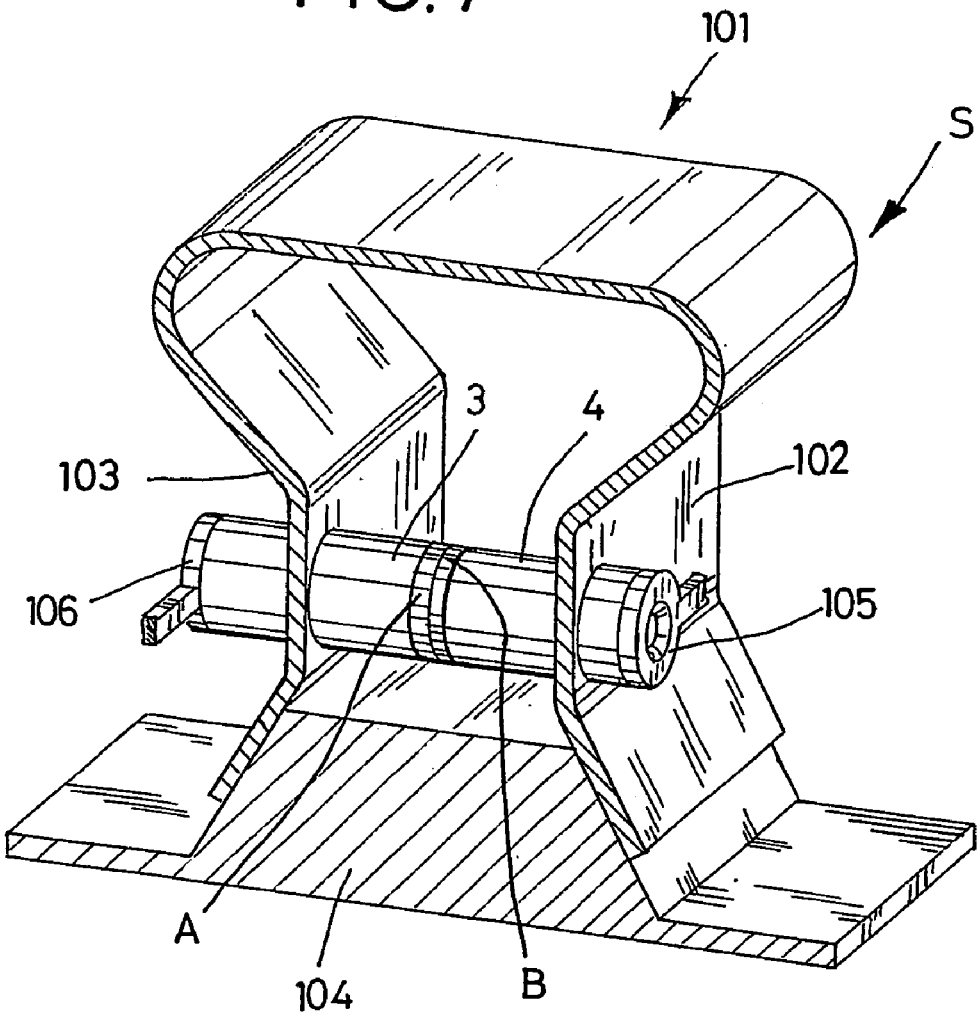
FIG. 7: shows diagrammatically a safety strip wherein the holding body is designed as a spring bracket.

Finally, FIG. 7 shows in section a safety strip S with a U-shaped spring bracket 101, the contact elements 3 and 4 being placed into the bracket legs 102, 103. An insulating wedge element 104 reaches with its wedge section between the ends of the bracket legs 102 and 103, which ends are widened in a wedge-shaped manner, and thus causes the contact elements 3 and 4 to move apart. Visible on the contact elements 3 and 4 are cable lugs 105 and 106, to which the corresponding current line 12 and 12*a* connect. In this case, the actual safety strip S can consist of metal, or, in like manner, can be produced as a molded plastic piece.

The invention claimed is:

1. A safety strip comprising a switching strip for a striking edge protection device or closing edge protection device with an electrical switching device, wherein the safety strip includes contact elements arranged in holding bodies, wherein the contact elements in a rest position abut each other at contact points under effect of an elastic prestress and, under effect of an outside force on an insulating wedge element arranged between the holding bodies, can be moved apart so that contact is interrupted, wherein the contact elements are arranged in the holding bodies transversely to a longitudinal extension of the safety strip and via the contact points make possible a current flow from one side of one of the holding bodies to a side of the other holding body.

2. Safety strip according to claim 1, wherein a) the safety strip is formed as an essentially U-shaped spring bracket, b) the contact elements are arranged transversely to bracket legs forming the holding bodies and the contact points make possible a current flow, c) the insulating wedge element acts on free ends of the spring bracket.

3. Safety strip according to claim 1, wherein the holding bodies are formed as contact strips.

4. Safety strip according to claim 3, wherein the contact strips are placed into a receiving space.

5. Safety strip according to claim 4, wherein the receiving space is closed off through an outer housing wall.

6. Safety strip according to claim 5, wherein the housing wall comprises elastic material.

7. Safety strip according to claim 5, wherein the housing wall comprises rigid material.

8. Safety strip according to claim 4, wherein the receiving space is bounded by elastic wall elements.

9. Safety strip according to claim 1, further comprising another contact strip, wherein the contact strips comprise plastic and are connected in a material-unified manner by a hinge strip.

10. Safety strip according to claim 9, wherein the contact strips consist of dimensionally stable material.

11. Safety strip according to claim 9, wherein the contact strips comprise rubber-elastic material.

12. Safety strip according to claim 1, further comprising another contact strip, wherein contact elements are arranged in a spaced-apart manner, viewed over the length of the safety strips.

13. Safety strip according to claim 1, wherein the contact elements are connected in series by an electrical conductor.

14. Safety strip according to claim 1, wherein the insulating wedge element comprises dimensionally stable material.

15. Safety strip according to claim 1, wherein the insulating wedge element is formed as an insulating wedge strip.

16. Safety snip according to claim 1, wherein the elastic prestress for the holding bodies is applied through elastic tension elements.

17. A safety strip comprising a switching strip for a striking edge protection device or closing edge protection device with an electrical switching device, wherein the safety strip includes at least one holding body that carries at least one sensor, that is acted upon by an elastic prestress in a rest state, and that reacts to action of an outer force on insulating wedge elements arranged between holding bodies, wherein a) each of the holding bodies is formed as a contact strip or spring bracket, b) and at least one sensor is arranged transversely to a longitudinal extension of the safety strip or the spring bracket and actuates the electrical switching device through sensor action.

* * * * *